United States Patent [19]

Iwamura et al.

[11] Patent Number: 4,646,977

[45] Date of Patent: Mar. 3, 1987

[54] SPRAY NOZZLE

[75] Inventors: Yoshinari Iwamura, Kobe; Katsunori Okimoto, Hiroshima; Toshio Teshima, Fukuyama; Shinobu Miyahara, Fukuyama; Shigetaka Uchida, Fukuyama; Taizo Sera, Fukuyama; Koichi Ozawa, Fukuyama, all of Japan

[73] Assignees: Nippon Kokan Kabushiki Kaisha, Osaka; H. Ikeuchi & Co., Ltd., Tokyo, both of Japan

[21] Appl. No.: 613,344

[22] Filed: May 23, 1984

[30] Foreign Application Priority Data

Nov. 2, 1983 [JP] Japan ..... 58-170386

[51] Int. Cl.[4] ..... B05B 1/02

[52] U.S. Cl. ..... 239/590.5; 239/599; 239/601

[58] Field of Search ..... 239/590, 590.3, 590.5, 239/553, 553.3, 553.5, 565, 601, 599, 597, 432, 489, 490; 366/341

[56] References Cited

U.S. PATENT DOCUMENTS

| | | | |
|---|---|---|---|
| 485,910 | 11/1892 | Dean | 239/590.5 X |
| 1,163,591 | 12/1915 | Eneas | 239/472 X |
| 1,967,577 | 7/1934 | Katz | 239/590.3 X |
| 2,774,631 | 12/1956 | Wahlin | 239/590.3 |
| 2,999,647 | 9/1961 | Sosnick | 239/601 X |
| 3,836,076 | 9/1974 | Conrad et al. | 239/597 X |
| 4,151,955 | 5/1979 | Stouffer | 239/590 X |

FOREIGN PATENT DOCUMENTS

| | | | |
|---|---|---|---|
| 2713738 | 9/1978 | Fed. Rep. of Germany | 239/489 |

*Primary Examiner*—Andres Kashnikow
*Assistant Examiner*—Daniel R. Edelbrock
*Attorney, Agent, or Firm*—Wenderoth, Lind & Ponack

[57] ABSTRACT

A spray nozzle which has a nozzle main body and opening at one end in fluid communication with an inflow hole passing into the central portion of the nozzle main body. The inflow hole has a rounded orifice portion in fluid communication with an elongated discharge slot at an opposite end of the nozzle main body. Stirring channels extend along and are in fluid communication with the inflow hole. Each stirring channel has a cup-shaped end which is laterally adjacent the rounded orifice portion of the inflow hole. The cut-shaped portion of the stirring holes causes a reverse flow of mixed gas and liquid which passes down the stirring channels such that mixed gas and liquid passing through the inflow hole towards the elongated discharge slot is agitated and a uniform spray with fine droplets is jetted from the discharge slot.

10 Claims, 33 Drawing Figures

Sauter avevage= 240μ

Sauter avevage = 180μ

SPRAY NOZZLE

BACKGROUND OF THE INVENTION

The present invention relates to a spray nozzle and more particularly to a spray nozzle, which produces a uniform spray distribution in a wide-angled, conical area, for instance in a gas/liquid mixing system, which is used in spray-cooling of high-temperature objects such as heated steel or the like.

To cool the high-temperature objects such as heated steel or the like in the course of a manufacturing process, a one-medium nozzle for spraying only liquid therethrough is conventionally used to cool the steel. This one-medium nozzle causes surface cracks in the heated steel due to the local excessive cooling conditions. Cracking should be avoided as the continuous steel casting method is developed to produce steel at high speed. To prevent the surface cracking of the steel and to shorten the manufacturing time, it is required to spread a gas/liquid mixed spray, with equal spray amount and equal liquid-droplet size, across a wide range on the surfaces of the steel. This can be accomplished with a double medium nozzle for passing two kinds of gas and liquid therethrough for the spraying operation, instead of the one-medium nozzle.

Conventionally the two-medium nozzle as described hereinabove was not satisfactory in providing the uniformity of the liquid flow distribution, the size variation of the liquid droplets, the expanded area of the spray in all directions and so on. To cope with the problems as described so far, there has conventionally been employed a double medium nozzle for a uniform spraying operation in a wide angled conical area with, as shown in FIGS. 1 to 5, but such a nozzle had disadvantages in that the uniformity of the liquid flow distribution was unstable, the widthwise expansion of the spray could not be made too large, and particle size of the liquid droplets became uneven.

More specifically, as shown in FIGS. 1 through 5, such a nozzle is made circular or oval, pseudo-oval in shape at the tip end 2*a* of a flow hole 2 axially formed in the nozzle main body 1, and is provided with a pair of V-shaped cuts 4, 4. Each cut 4 in the body 1, when viewed from the outside as shown in FIG. 3, forms groove of V-shape which faces the opposite cut 4 along the center line of tip end 2*a*. The V-shape grooves connect with the circular tip end of the hole to form a discharge slot 3. When a gas and water mixed fluid is fed into the flow hole 2 of the nozzle with such a shape as shown in FIGS. 1 to 5, gas "a" is depressed towards opposite sides of the flow hole as the tip end becomes smaller in diameter, and the liquid "w" concentrates in the central portion of the flow hole, because the liquid is non-compressive while the gas is compressive. Accordingly, the gas/liquid spray jetted from the discharge slot 3 produces fine droplets only along both sides of the expansion area, while the central portion of the area has almost liquid only, which becomes liquid droplets of rough particle sizes, resulting in that the width of the spray in the central portion is not spread in a larger area.

SUMMARY OF THE INVENTION

Accordingly, an essential object of the present invention is to provide a one-piece double medium nozzle for spraying uniform spray, which can eliminate the disadvantages of the conventional nozzles as described so far, and is arranged to prevent the gas and water mixed fluid from being separated when sprayed near the discharge slot of the nozzle body, thereby to allow the uniform fine droplets to be sprayed across an entire spray expanse.

Another object of the present invention is to provide a double medium nozzle for producing a spray distribution with mixed air and water, in which the spraying angle of the spray is always kept constant in spite of variation in the amount of the mixed air and water, such that the spray distribution is uniform within a given area.

In accomplishing these and other objects, according to one preferred embodiment of the present invention, there is provided a spray nozzle of a double medium type, which comprises a nozzle main body, an inflow hole for a gas and water mixed fluid, axially formed to extend through a central portion of the nozzle main body, said inflow hole being gradually reduced in diameter towards its end portion to form an orifice portion thereat, a pair of front and a pair of rear inclined, opposed faces symmetrically cut outwardly on opposite sides and in an end face of said nozzle body, an elongated discharge slot extending back and forth and formed at the end portion of the orifice portion of said inflow hole by the cut for said inclined faces for directing the spraying in the back and forth direction, stirring channels symmetrically formed along lateral opposite longitudinal sides of said inflow hole, the stirring channels intersecting the inflow hole at right angles to the spraying direction, said stirring channels being each gradually reduced in cross-section towards its end portion to form a cup-shaped end face which is laterally adjacent the orifice portion of said inflow hole at the side portion thereof along the inner side of the end portion of each stirring channel, whereby the gas and water mixed fluid flowing into said stirring channels flows backwards into the orifice portion of the inflow hole along the end portion so as to agitate the gas and water mixed fluid in the inflow hole immediately before jetting.

By the arrangement of the present invention as described above, an improved spray nozzle of double medium type has been advantageously presented in which separation of gas and liquid is prevented, and fine droplets of the liquid can be spread over the entire expansion of spray.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
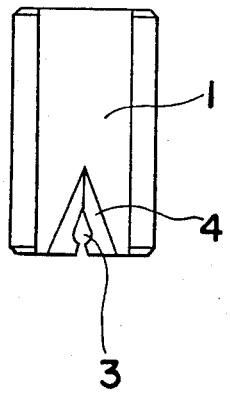
Fig. 1 PRIOR ART
FIG. 1 is a front elevational view of a conventional spray nozzle (already referred to)
Figure 2:
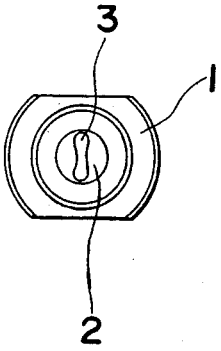
Fig. 2 PRIOR ART
FIG. 2 is a top plan view of the spray nozzle of FIG. 1 (already referred to)
Figure 3:
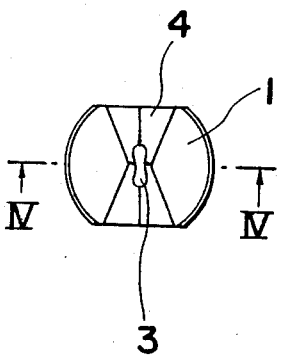
Fig. 3 PRIOR ART
FIG. 3 is a bottom plan view of the spray nozzle of FIG. 1 (already referred to)
Figure 4:
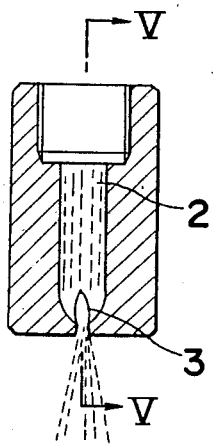
Fig. 4 PRIOR ART
FIG. 4 is a cross section taken along the line IV—IV in FIG. 3 (already referred to)
Figure 5:
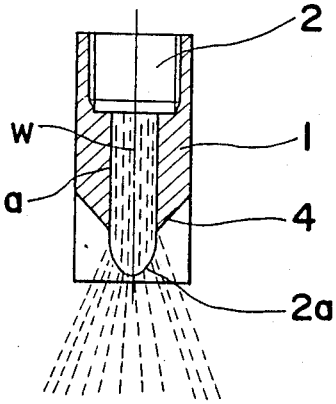
Fig. 5 PRIOR ART
FIG. 5 is a cross section taken along the line V—V in FIG. 4 (already referred to)

Before the description of the present invention proceeds, it is to be noted that like parts are designated by like reference numerals throughout the accompanying drawings.

Figure 7:
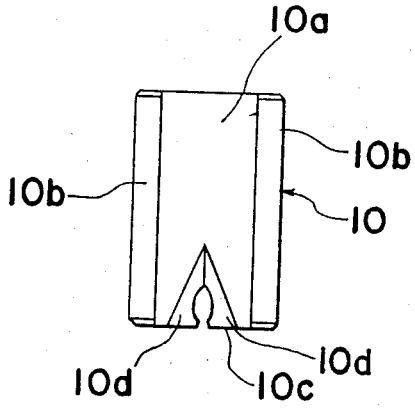
FIG. 7 is a front elevational view of an improved spray nozzle according to one preferred embodiment of the present invention.
Figure 8:
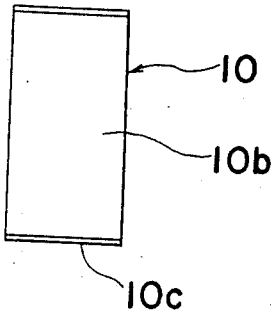
FIG. 8 is a side elevational view of the spray nozzle of FIG. 7.
Figure 9:
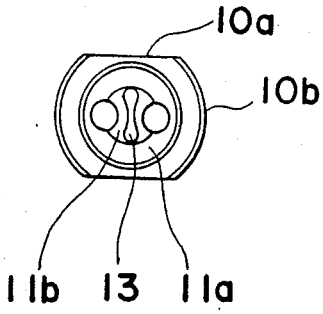
FIG. 9 is a top plan view of the spray nozzle of FIG. 7.
Figure 10:
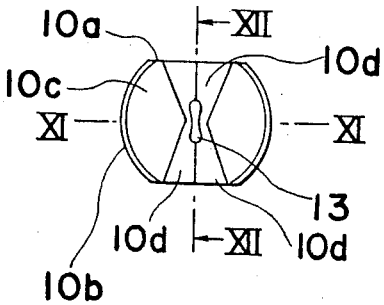
FIG. 10 is a bottom plan view of the spray nozzle of FIG. 7.

Referring now to the drawings, there is shown, in FIGS. 7 through 13, an improved spray nozzle of a double medium type according to one preferred embodiment of the present invention, which includes a nozzle main body 10 generally oblong or oval in cross section, having flat outer faces 10*a* formed on its opposite front and rear sides. The main body 10 has semi-circular or arcuate outer faces 10*b* formed on opposite lateral sides thereof as is most clearly seen in FIG. 9. The nozzle main body 10 is provided with a pair of front and a pair of rear inclined, opposed faces 10*d* symmetrically cut into a V-shaped discharge groove on each flat outer face 10*a*, each groove extending upwardly from a lower end face 10*c* of the main body 10 (FIGS. 7 and 10). Each of the above V-shaped grooves is tapered upwardly and expands at a lower end towards the opposite sides 10*b*. Each groove begins from an upward portion on face 10*a* and extends into the nozzle main body to a central portion of the end face 10*c*. The intersection of the discharge groove and the inflow hole forms an elongated discharge opening.

A gas/water mixed fluid inflow hole 11 of circular cross-section, which is opened at its upper end, is vertically formed along an axial line L1 of the nozzle main-body 10, in the central portion of the nozzle main body 10. The inflow hole 11 has its upper side portion as a larger diameter portion 11*a* and its lower side as a smaller diameter portion 11*b*. The tip end portion of the smaller diameter portion 11*b* is gradually reduced to provide an orifice portion 11*c*, whose bottom face is round in cross-section. The bottom face of the orifice portion 11*c* is positioned slightly inwardly from the tip end face 10*c* of the nozzle main-body 10. The tip end portion of the orifice portion of the inflow hole 11 is open across both the front and rear sides from the bottom-face central portion through the V-shaped grooves to form a discharge slot 13 which is elongated in a direction normal to the longitudinal center axis of the main body 10 as shown in FIGS. 9 and 10. Consequently, spray to be jetted from the discharge slot 13 may be directed in the front and rear direction. Stirring channels 14, which are rounded in cross-section, are symmetrically formed, on both right and left side portions of the central smaller diameter portion 11*b*, opening onto the larger diameter portion 11*a* of the inflow hole 11, within the nozzle main-body 10. Each of the stirring channels 14 extends parallel to the axis of the main body to a position close to the lower end of the nozzle main-body, with the inner longitudinal side portion of each stirring channel being communicated with the inflow hole smaller diameter portion 11*b*. Each stirring channel 14 is gradually reduced in cross-section towards the tip-end face 10*c* at its bottom end portion to form a cup-shaped bottom face 14*a* which is rounded in cross-section. The bottom face 14*a* of each channel is located adjacent to the right and left direction, at a position laterally adjacent the inflow hole bottom-face 11*c*, thereby to communicate the inner side portion of each stirring channel, slightly above the bottom face 14*a*, with the right and left side faces of the orifice portion 11*c* of the inflow hole 11. As shown in FIG. 9, the longitudinal axis of each stirring channel 14 is provided in a plane which is normal to the direction of the elongated discharge slot 13.

Figure 11:
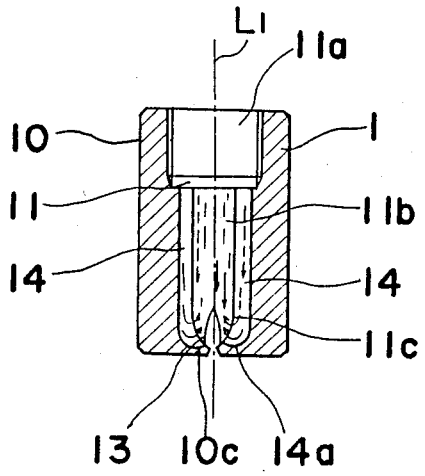
FIG. 11 is a cross section taken along the line XI—XI in FIG. 10.
Figure 12:
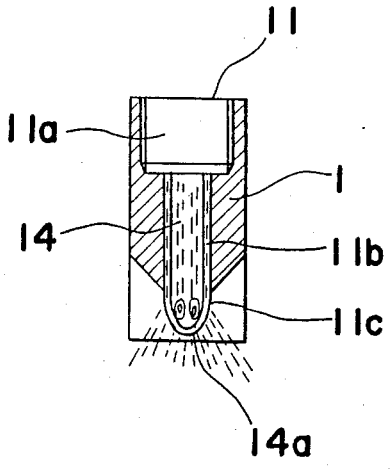
FIG. 12 is a cross section taken along the line XII—XII in FIG. 10.
Figure 13:
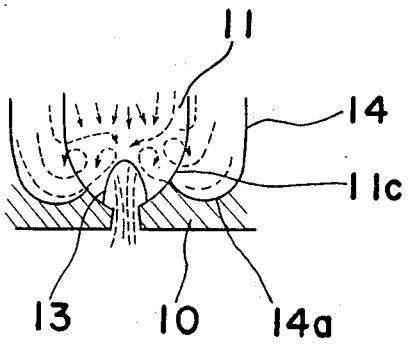
FIG. 13 is a diagram showing, on an enlarged scale, the main portion in FIG. 10.

In the spray nozzle having the construction as described above, the gas/water mixed fluid is divided to flow into the central small diameter portion 11*b* and the stirring channels 14 on the opposite sides from the large diameter portion 11*a* of the inflow hole 11, and flows respectively along the axis of the nozzle main body. The gas/water mixed fluid, which has flowed into the stirring channels 14, reaches the bottom cup-shaped face 14*a*, and flows in a reverse direction (as shown in FIGS. 11 and 13) back into the orifice portion 11*c* of the inflow hole 11 communicated with the cup-shaped bottom faces 14*a*. The gas/water mixed fluid flowing down the orifice portion 11*c* is stirred, as shown in FIG. 13 by the reversely flowing inflow liquid from the stirring channels 14. Accordingly, at the orifice portion 11*c*, the liquid and gas, which are locally separated so that the liquid is present at the central portion, with the gas being located therearound, are uniformly mixed through agitation by the reverse flow from the stirring channels, and thus, a uniform gas/water mixed fluid is obtained in the vicinity of the discharge slot 13. Thus, fine liquid droplets are produced in the gas/water mixed state across the entire expanse of the spray to be jetted from the discharge slot 13. In this case, since the stirring channels are provided in the direction normal to the jetting direction, the expanse of the spray in the widthwise direction is not interfered with, because the stirring and mixing between the gas and liquid is uniformly performed across the entire expanse direction. Since the gas and the liquid are not separated from each other in the expanse direction, the flow rate distribution is also readiy controlled uniformly, with a simultaneous widening of the spray width.

Comparative experiments in the spray droplet diameter and in the flow rate distribution were made by the use of the spray nozzle of the present invention shown in FIGS. 7 through 13 and the conventional spray nozzle shown in FIGS. 1 to 5.

DROPLET DIAMETER COMPARATIVE EXPERIMENTS

Figure 14:
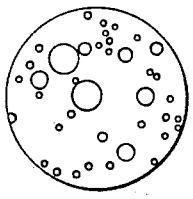
FIGS. 14(*a*) and 14(*b*) are diagrams showing results of droplet diameter comparative experiments.
Figure 14:
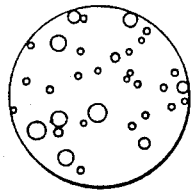

The conventional spray nozzle (FIGS. 1 through 5) and the spray nozzle of the present invention (FIGS. 7 through 13) were processed into the same dimensions in the configurations of the inflow holes and orifices, and spraying was effected by using the above spray nozzles through employment of the same gas/water mixed fluid, under air pressure at 4 kg/cm$^2$ and liquid pressure also at 4 kg/cm$^2$. The resultant spray particles are shown in FIGS. 14(*a*) and 14(*b*), in which Sauter mean droplet diameter in the case of the conventional spray nozzle was 240 micrometers (FIG. 14(*a*)), and that in the case of the spray nozzle of the present invention was 180 micrometers. From the above findings, it has been proven that the spray nozzle of the present invention provided with the stirring channels has the smaller Sauter mean droplet diameter, with air being mixed up to the central portion of the spray, thus contributing to a finer particle size.

FLOW-RATE DISTRIBUTION COMPARATIVE EXPERIMENTS

Figure 6:
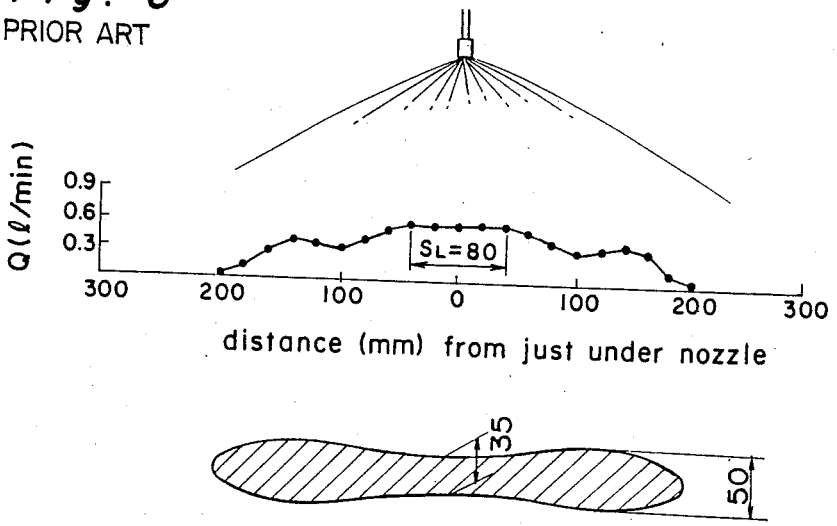
Fig. 6 PRIOR ART
FIG. 6 is a diagram showing results of flow rate distribution for the conventional spray nozzle of FIG. 1.
Figure 15:
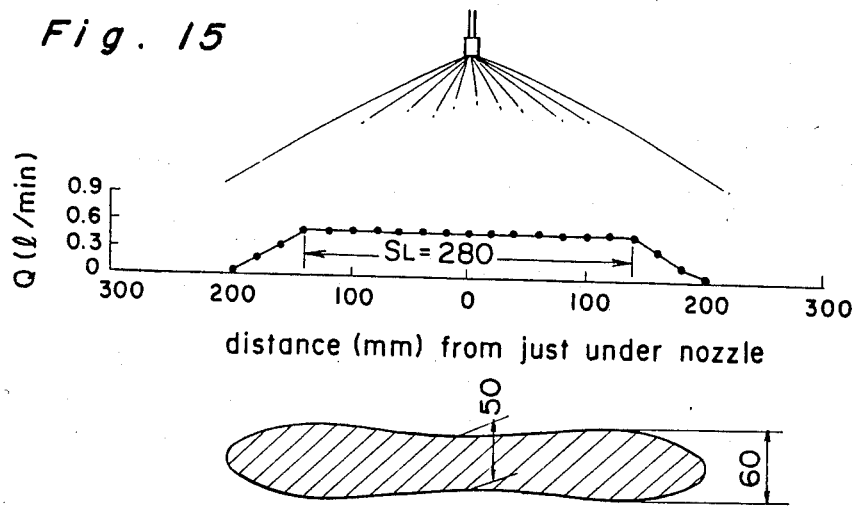
FIG. 15 is a diagram showing results of flow rate distribution experiments for the spray nozzle of the present invention.

In the similar manner as in the above droplet diameter comparative experiments, the conventional spray nozzle (FIGS. 1 through 5) and the spray nozzle of the present invention (FIGS. 7 through 13) were processed into the same dimensions in the configurations of orifices, etc., and spraying was effected by using the above spray nozzles through employment of the same gas/water mixed fluid, under air pressure at 3 kg/cm$^2$ and liquid pressure also at 3 kg/cm$^2$, while at a position of spraying height of 100 mm, the flow rate distribution was measured in the direction of expanse of the spray, with a simultaneous measurement of spray thickness by a spray pattern. The results of the above experiments are shown in FIGS. 6 and 15. In the results for the conventional nozzle shown in FIG. 6, the spray was spread over 400 mm, with a length SL at an equal portion being 80 mm and the half of flow rate was provided in a position spaced by 100 mm from just under the nozzle. Meanwhile, the spray thickness was as narrow as 35 mm at the central portion. On the other hand, in the case of the nozzle of the present invention as shown in FIG. 15, the spray is spread over 400 mm as in the conventional type, but the length SL at the equal portion is markedly increased to 280 mm. Moreover, the spray thickness becomes 50 mm at the central portion, which is thicker than in the conventional type. It has been proven from the above results that, in the nozzle of the present invention, the gas and liquid are sufficiently stirred near the orifice to jet the gas/water mixed fluid almost uniformly in the expanse direction of the spray so that the uniform flow rate distribution can be stably achieved and the spray of a large width can be provided.

Figure 16:
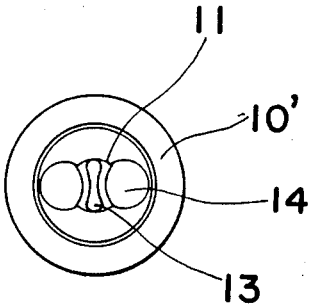
FIG. 16 is a top plan view of a spray nozzle according to a modification of the present invention.
Figure 17:
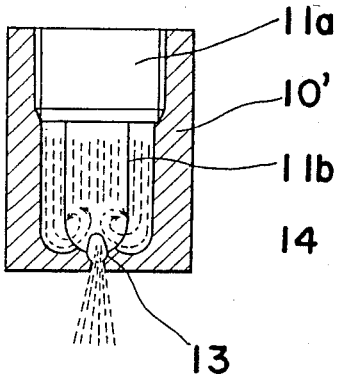
FIG. 17 is a longitudinal cross section of the spray nozzle of FIG. 16.
Figure 18:
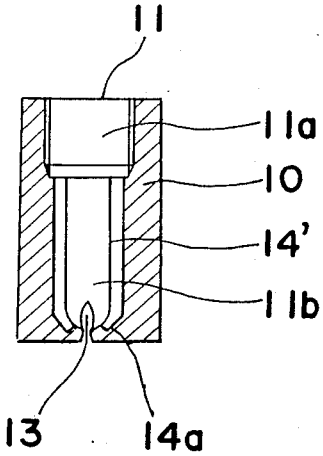
FIG. 18 is a longitudinal cross section of a spray nozzle according to another modification of the present invention.
Figure 19:
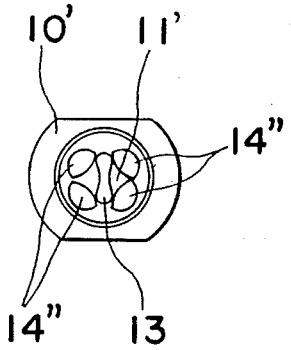
FIG. 19 is a top plan view of a spray nozzle according to a further modification of the present invention.
Figure 20:
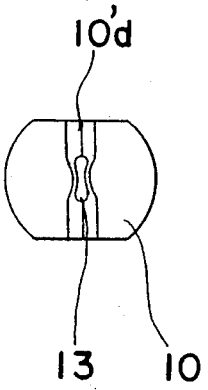
FIG. 20 is a bottom plan view of the spray nozzle of FIG. 19.
Figure 21:
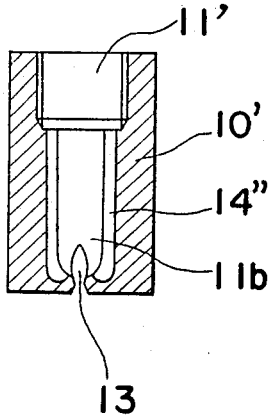
FIG. 21 is a longitudinal sectional view of the spray nozzle of FIG. 19.
Figure 22:
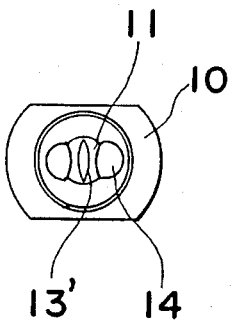
FIG. 22 is a top plan view of a spray nozzle according to a still further modification of the present invention.
Figure 23:
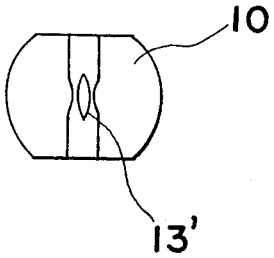
FIG. 23 is a bottom plan view of the spray nozzle of FIG. 22.
Figure 24:
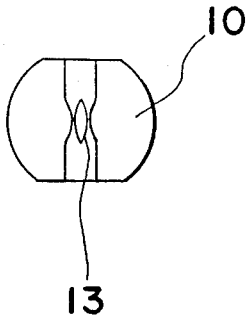
FIG. 24 is a bottom plan view of a spray nozzle according to still another modification of the present invention.
Figure 25:
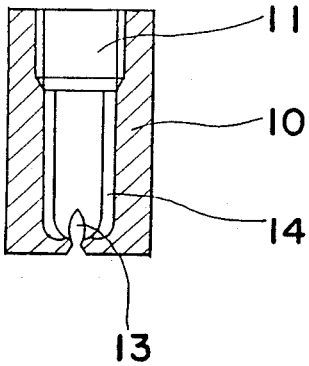
FIG. 25 is a longitudinal sectional view of the spray nozzle of FIG. 24.
Figure 26:
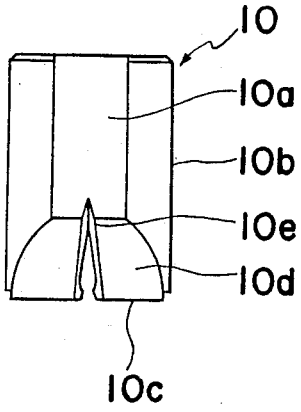
FIG. 26 is a front elevational view of a spray nozzle according to another modification of the present invention.
Figure 27:
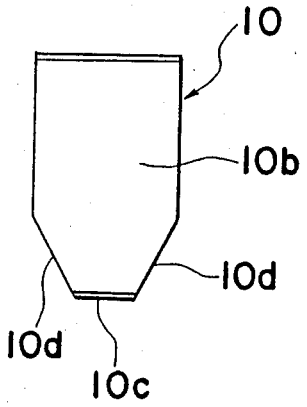
FIG. 27 is a side elevational view of the spray nozzle of FIG. 26.
Figure 28:
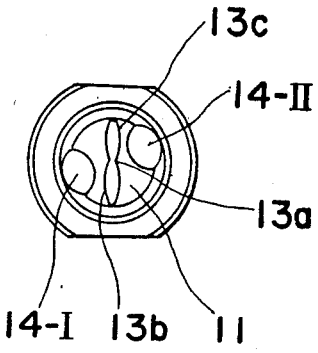
FIG. 28 is a top plan view of the spray nozzle of FIG. 26.
Figure 29:
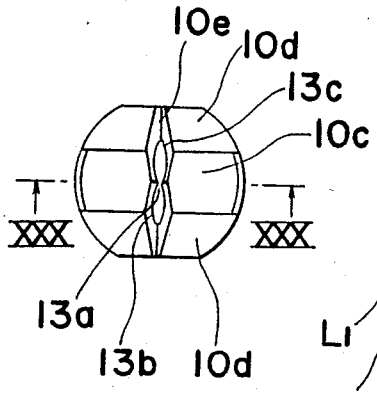
FIG. 29 is a bottom plan view of the spray nozzle of FIG. 26.
Figure 30:
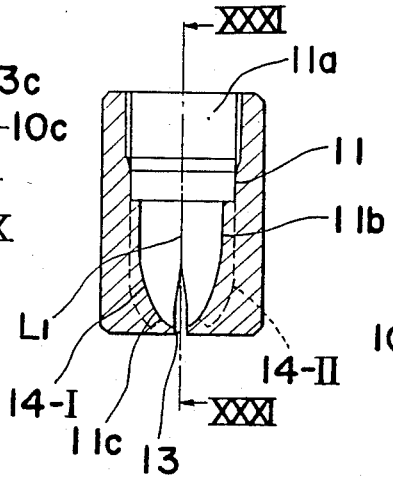
FIG. 30 is a cross section taken along the line XXX—XXX in FIG. 29.
Figure 31:
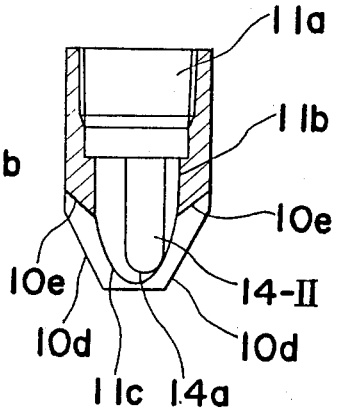
FIG. 31 is a cross section taken along the line XXXI—XXXI in FIG. 30.

It should be noted here that the present invention is not restricted to the embodiment shown in FIGS. 7 to 13, but may be modified in various ways within the scope of the invention. For example, the nozzle main-body 10' may be circular in section as shown in FIGS. 16 and 17. Also, as shown in FIG. 18, the tip end 14'*a* of the stirring channel 14' may be made conical, and is not necessarily required to be made round. In addition, as shown in FIGS. 19 to 21, two stirring channels 14'' may be provided, respectively, in the direction normal to the spraying direction of the inflow hole 11'. In this case, the inclined face 10'*d* of the V-shaped groove to be notched in the nozzle tip end face is made narrower in width without being outwardly spread out, so that the bottom face of the stirring channel 14'' may not be opened. In addition, as shown in FIGS. 22 and 23, the discharge slot 13' may be made into an elliptical shape elongated in the longitudinal direction. It is to be noted that the cut is not limited to the V-cut, but the discharge slot may be made into an elliptical shape by a U-cut as shown in FIGS. 24 and 25.

In the modified embodiment shown from FIG. 16 to FIG. 25, like parts in the embodiment of FIGS. 7 to 13 are designated by like reference numerals for abbreviation of the detailed description, since other constructions than those described above are generally similar thereto.

As is clear from the above description, according to the spray nozzle of the present invention, the stirring channels are symmetrically provided in positions normal to the spraying direction so that the gas/water mixed fluid in the orifice near the discharge slot is sufficiently stirred thereby to prevent the separation between the liquid and gas in the vicinity of the discharge slot. Thus, there is such an effect that fine liquid-droplets are produced in the gas/water mixed state across the entire expanse of the spray, with an extremely large effect in the uniformity of flow-rate distribution, and spreading of spray, etc.

Referring further to FIGS. 26 through 32, there is shown a spray nozzle according to a still further modification of the present invention.

In this modification, at the portion from each of the inclined faces 10*d* towards its tip end face 10*c*, a tapered face 10*e* is cut on each side of the nozzle orifice 13 into a V-shape generally at the central portion of faces 10*d*. The tapered faces 10*e* form a V-shaped groove on each inclined face 10*d* which is wider at end face 10*c*. Each groove on each face 10*d* terminates at a point on opposite sides 10*a*.

Meanwhile, since the V-shaped groove, formed from tapered faces 10*e*, is extended from the central portion of faces 10*d* towards the opposite front and rear sides, while being expanded, the discharge slot 13 has a minimum width at its central portion 13*a* and is expanded towards the opposite front and rear sides, thus presenting a so-called figure-8 shape, with maximum width portions 13*b* and 13*c* being located at the opposite front and rear sides.

Within the nozzle main body 10, stirring channels 14-I and 14-II, each arcuate in cross-section, are formed at the left side front portion and right side rear portion of the central small diameter portion 11*b* so as to be open into the large diameter portion 11*a* of the inflow hole 11.

Each of the stirring channels 14-I and 14-II extends along the length of the nozzle main body to a position close to the lower end of the nozzle main-body, with the inner longitudinal side portion of each stirring channel being communicated with the inflow hole smaller diameter portion 11*b*, and is gradually reduced in cross-section towards end face 10*c* at its bottom end portion to form a cup-shaped bottom face 14*a*. The bottom face 14*a* is located at a position laterally adjacent the inflow hole bottom-face 11*c*, while the discharge slot 13 is positioned, with the central portion 13*a* and the opposite front and rear portions 13*b* and 13*c* of the maximum width being offset laterally to the stirring channels. These stirring channels 14-I and 14-II have their inner longitudinal sides slightly above the bottom face 14*a* communicated with the left side front portion and the right side rear portion of the orifice portion 11*c* of the inflow hole 11.

Figure 32:
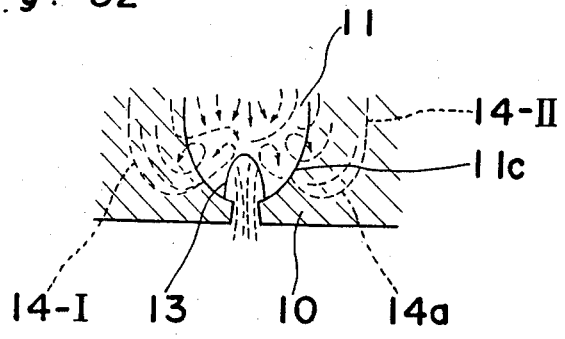
FIG. 32 is a diagram showing, on an enlarged scale, the essential portion in FIG. 30.

In the modified spray nozzle of FIGS. 26 to 32 as described above, the gas/water mixed fluid is divided to flow along the axis of the main nozzle body and into the central small diameter portion 11*b* and the stirring channels 14-I and 14-II on the opposite sides from the large diameter portion 11*a* of the inflow hole 11. The gas/water mixed fluid, which has flowed into the stirring channels 14-I and 14-II, reaches the bottom cup-shaped face 14*a*, and flows in a reverse direction as shown, back into the orifice portion 11*c* of the flow hole 11 communicated with the cup-shaped bottom faces 14*a*. The gas/water mixed fluid flowing down the orifice portion 11*c* is stirred, as shown in FIG. 32, by the reversely flowing inflow liquid from the stirring channels 14. Accordingly, at the orifice portion 11*c*, the liquid and gas, which are locally separated so that the liquid is present at the central portion, with the gas being located therearound, are uniformly mixed through agitation by the reverse flow from the stirring channels 14-I and 14-II, and thus, a particularly uniform gas/water mixed fluid is obtained in the vicinity of the maximum width portion 13*b* and 13*c* of the discharge slot 13. Thus, fine liquid droplets are produced in the gas/water mixed state across the entire expanse of the spray to be jetted from the discharge slot 13. In this case, since the stirring channels 14-I and 14-II are provided in the direction normal to the jetting direction and at the opposite front and rear sides, the expanse of the spray in the widthwise direction is not interfered with, because the stirring and mixing between the gas and liquid is uniformly performed across the entire expanse direction. Since the gas and the liquid are not separated from each other in the expanse direction, the flow-rate distribution is also readily controlled uniformly, with a simultaneous widening of the spray width.

Since other constructions and effects of the modified spray nozzle in FIGS. 26 to 32 are similar to those in the foregoing embodiments, detailed description thereof is abbreviated here for brevity, with like parts being designated by like reference numerals.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A spray nozzle comprising:

a nozzle main body, said nozzle main body extending in a longitudinal direction and having an inflow hole extending axially along a central axis of said nozzle main body to define a hole into a central portion of said nozzle main body, said inflow hole having an opening at an upstream end of said nozzle main body, said nozzle main body having a discharge opening at a downstream end of said nozzle main body and, said inflow hole being of circular cross-section and having a diameter which decreases towards said discharge opening to form a rounded orifice portion of said inflow hole;

said nozzle main body having a discharge groove formed by opposed faces extending across said downstream end of said nozzle main body, said discharge groove intersecting said orifice portion of said inflow hole to define a discharge opening therefrom having an elongated shape which extends in the same direction as that of said opposed faces, said direction being normal to said central axis of said nozzle main body;

means for agitating gas and liquid mixed fluid passed through said inflow hole comprising stirring channels which extend along and are in fluid communication with opposite longitudinal sides of said inflow hole, said channels having an upstream end in fluid communication with said opening in said upstream end of said nozzle main body, each of said channels having a downstream end portion which is cup-shaped, said cup-shaped portion being laterally adjacent to said orifice portion of said inflow hole, each cup-shaped portion being separated from and not in fluid communication with any other cup-shaped portion, each of said stirring channels being parallel to said central axis of said nozzle main body and in fluid communication with said inflow hole at a position upstream of said cup-shaped portion;

whereby gas and liquid mixed fluid being passed through said inflow hole are stirred near the orifice portion of said inflow hole by means of said cup-shaped portion of each of said stirring channels which cause the reverse flow of gas and liquid mixed fluid which passes through said stirring channels towards said elongated discharge opening.

2. The spray nozzle of claim 1 wherein said nozzle main body is generally oblong in cross-section in a plane which is perpendicular to said central axis of said nozzle main body.

3. The spray nozzle of claim 1 wherein said nozzle main body is generally circular in cross-section in a plane which is perpendicular to said central axis of said nozzle main body.

4. The spray nozzle of claim 1 wherein said cup-shaped portion of each of said stirring channels is conical in cross-section in a plane which is parallel to said central axis of said nozzle main body.

5. The spray nozzle of claim 1 wherein said cup-shaped portion of each of said stirring channels is rounded in cross-section in a plane which is parallel to said central axis of said nozzle main body.

6. The spray nozzle of claim 1 wherein said elongated discharge opening has a configuration generally in the form of a figure eight in a plane which is perpendicular to said central axis of said nozzle main body, said configuration being narrower near the center portion of said discharge opening and wider on each side of said center portion.

7. The spray nozzle of claim 6 wherein a pair of said stirring channels are located on either side of said elongated discharge opening, each of said stirring channels being adjacent a respective one of said wider portions of elongated discharge opening.

8. The spray nozzle of claim 6 wherein two stirring channels are located on opposite sides of said inflow hole and are diametrically opposed, one of said stirring channels being adjacent one wider portion of said elongated discharge slot and the other of said stirring channels being adjacent the other wider portion of said elongated discharge opening.

9. The spray nozzle of claim 1 wherein said opposed faces which form said elongated discharge groove across said downstream end of said nozzle main body comprises a V-shaped groove which extends across the downstream end of said nozzle main body, said elongated discharge opening formed by the intersection between said V-shaped groove and said orifice portion of said inflow hole being an elongated discharge slot which extends in the same direction as said V-shaped groove.

10. The spray nozzle of claim 1 wherein said opposed faces which form said elongated discharge groove across said downstream end of said nozzle main body comprise a U-shaped groove which extends across the downstream end of said nozzle main body, said elongated discharge opening formed by the intersection between said U-shaped groove and said orifice portion of said inflow hole being an elongated elliptical discharge slot which extends in the same direction as said U-shaped groove.

* * * * *